United States Patent [19]

Murnane et al.

[11] 4,408,467

[45] Oct. 11, 1983

[54] NOISE SUPPRESSING FEEDER TUBE FOR A REFRIGERANT CIRCUIT

[75] Inventors: Raymond J. Murnane; Stephen C. Gomore, both of Minoa; Myron Mathewson, Syracuse, all of N.Y.

[73] Assignee: Carrier Corporation, Syracuse, N.Y.

[21] Appl. No.: 323,798

[22] Filed: Nov. 23, 1981

[51] Int. Cl.[3] ..... F25D 19/00

[52] U.S. Cl. ..... 62/296; 62/511

[58] Field of Search ..... 62/296, 511

[56] References Cited

U.S. PATENT DOCUMENTS

| | | | |
|---|---|---|---|
| 1,791,528 | 2/1981 | Hull | 62/511 |
| 3,461,683 | 8/1969 | Valbjorn et al. | 62/296 X |
| 3,531,947 | 10/1970 | Drury et al. | 62/511 |
| 3,967,489 | 7/1976 | Pohl et al. | 62/511 X |
| 4,086,782 | 5/1978 | Forsberg | 62/296 |
| 4,150,558 | 4/1979 | Pohl | 62/511 X |
| 4,231,228 | 11/1980 | Galvin et al. | 62/77 |

FOREIGN PATENT DOCUMENTS

| | | | |
|---|---|---|---|
| 146223 | 4/1952 | Australia | 62/511 |

*Primary Examiner*—Lloyd L. King

*Attorney, Agent, or Firm*—Donald F. Daley; Robert P. Hayter

[57] ABSTRACT

A noise suppressing feeder tube for use in a refrigeration circuit is disclosed. A single unitary member having a middle portion flattened to reduce this cross-sectional diameter is disclosed for connecting a capillary tube to the evaporator of a small refrigeration circuit. By forming a unitary piece with a reduced cross-sectional area it has been found that refrigerant noise as is caused during the turbulent flow from the capillary tube to the evaporator may be suppressed.

4 Claims, 4 Drawing Figures

NOISE SUPPRESSING FEEDER TUBE FOR A REFRIGERANT CIRCUIT

BACKGROUND OF THE INVENTION

1. Field of the Invention

The present invention relates to a refrigeration circuit. More particularly, the present invention concerns a feeder tube for connecting an expansion device to the evaporator of a refrigeration circuit while suppressing noise generated by refrigerant flow through the feeder tube.

2. Description of the Prior Art

In a typical vapor compression air conditioning system, a refrigeration circuit including a compressor, condenser, evaporator and expansion device is provided for transferring heat energy between two heat sinks. The compressor acts to raise the pressure and temperature of a gaseous refrigerant which is then conducted to the condenser wherein heat energy is rejected from the gaseous refrigerant to condense the refrigerant to a liquid. Liquid refrigerant is then conducted through an expansion device where it undergoes a pressure drop. The reduced pressure refrigerant is then conducted to the evaporator where it flashes or boils absorbing heat energy from air flowing over the evaporator to effect cooling of the air. The refrigerant is then returned to the compressor to complete the refrigeration circuit.

In many small refrigeration circuits a capillary tube is utilized as an expansion device. Liquid refrigerant is reduced in pressure as it flows through the capillary tube and then must be conducted to the appropriate circuits in the evaporator. This refrigerant undergoes a pressure decrease as it flows through the flow restrictor and may be discharged from the capillary in the form of a liquid or gas or a mixture of the two. The boiling turbulence resulting from vaporization of the refrigerant as well as the exit velocity of the refrigerant from the capillary tube, which may be close to sonic speed, constitute a major source of noise in the operation of the refrigeration circuit. This noise can be particularly bothersome in the operation of a room air conditioner with a refrigeration circuit located proximate to the person detecting the noise level. A means for isolating the source of noise from the enclosure being conditioned has been to locate the outlet end of the flow restrictor on the outdoor side of the partition separating the room air conditioner into indoor and outdoor sections. This requires an additional unrestricted connecting tube for connecting the outlet end of the flow restrictor to the inlet end of the evaporator which is positioned in the indoor compartment.

Another method of accomplishing noise suppression within a feeder tube has been the utilization of a plurality of tubes, each having a different diameter, such that the refrigerant being discharged from the capillary tube enters a large diameter tube, travels to a lesser diameter tube, flows into a larger diameter tube and is then conducted back to the evaporator. This type of arrangement requires numerous tubes of varying sizes and numerous brazing or soldering steps to accomplish an assembly to serve this purpose. By the utilization of numerous components and numerous connections, the possibility of error or improper joining is greatly increased.

The present invention is directed to a feeder tube formed from a unitary piece. A single piece of copper tubing may have a portion flattened in a die to reduce the cross-sectional area. By flattening this portion the same effect as directing the refrigerant through a reduced diameter tube is created. Noise suppression within the tube is accomplished by restricting the volume of the tube in the reduced diameter portion. The cylindrical end portions of the tube remain unaffected during the flattening process such that they may be connected to the appropriate capillary tube and evaporator or other component of the system.

SUMMARY OF THE INVENTION p It is an object of the present invention to provide a feeder tube for an air conditioning system.

It is a further object of the present invention to provide a feeder tube made from a single tubular element.

It is another object of the present invention to provide a feeder tube having a flattened portion for effecting noise reduction.

It is a further object of the present invention to provide a feeder tube for use in manufacturing an air conditioning unit which is easy to assemble and reduces the number of joints formed therein.

These and other objects will be apparent from the description to follow and from the appended claims.

These objects are achieved according to the preferred embodiment of the invention by the provision of a feeder tube for use in an air conditioning unit. The feeder tube joins the expansion device to the evaporator, said feeder tube having a first cylindrical end for joining to the expansion device, a flattened portion of a reduced cross-sectional area and a discharge end of cylindrical configuration for joining to the condenser, said flattened portion acting to suppress noise caused by the flow of refrigerant from the expansion device to the condenser. The feeder tube is made from a single integral part having a U-shaped flattened portion between the cylindrical ends.

THE DESCRIPTION OF THE PREFERRED EMBODIMENT

The invention as described herein will refer to a feeder tube for use in a refrigeration circuit as may be found in a room air conditioning unit. This feeder tube has specific dimensions and is formed of a specific configuration to be adapted in a specific unit. It is to be understood by those skilled in the art that similar configurations and design modifications may be accomplished within the spirit and scope of the invention.

Figure 1:
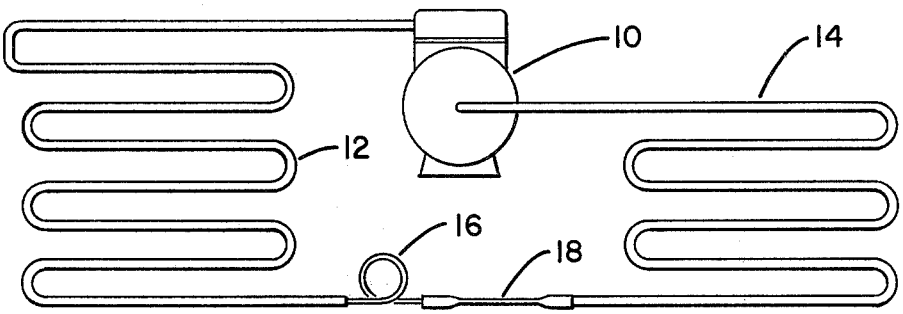
FIG. 1 is a schematic view of a refrigeration circuit.

Referring now to FIG. 1 there may be seen a schematic view of a simple refrigeration circuit. Compressor 10 is connected to conduct gaseous refrigerant to condenser 12 wherein the refrigerant is condensed to a liquid. Liquid refrigerant from condenser 12 flows to capillary 16 which effects a pressure drop therein. From capillary 16 refrigerant flows through feeder tube 18 to evaporator 14. Within the evaporator the refrigerant is boiled to a gas absorbing heat energy from the air flowing over the evaporator. The gaseous refrigerant from the evaporator is then returned to the compressor to complete the cycle.

Feeder tube 18 is located to connect capillary tube 16 with evaporator 14 to direct the low pressure refrigerant being discharged from the capillary tube to the evaporator. This refrigerant may be liquid or a liquid-gas mixture. The pressure drop across the capillary is caused by the internal flow resistance of the small diameter tube having a large volume of liquid refrigerant flowing therethrough. Typically, the exit velocity from the capillary tube is extremely high such that there is considerable turbulence and exit flow irregularities as the mixture is discharged from the capillary.

Figure 3:
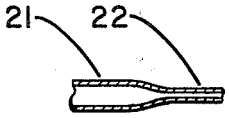
FIG. 3 is a sectional view of FIG. 2 taken at line III—III.
Figure 2:
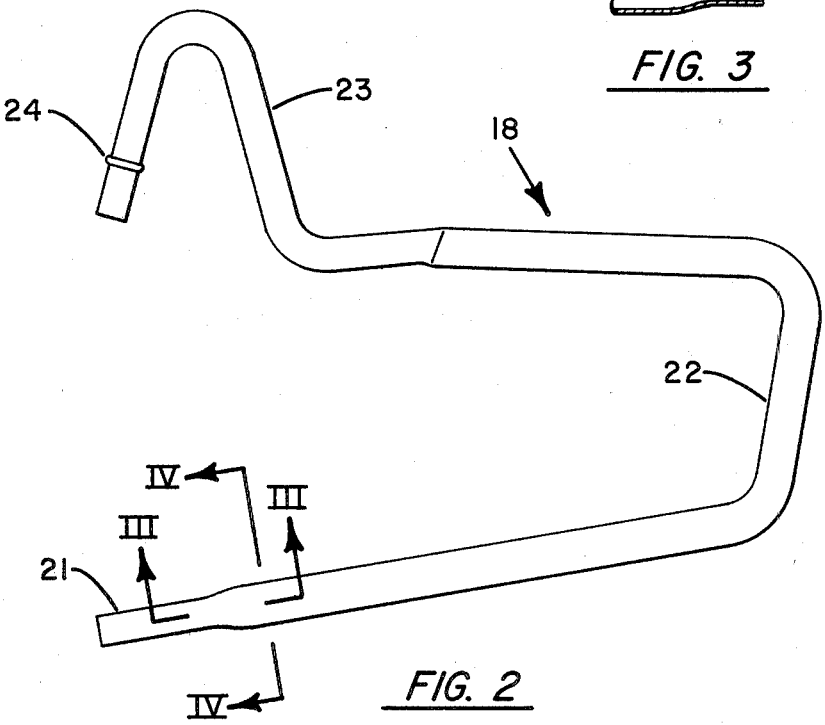
FIG. 2 is an isometric side view of the feeder tube.

FIGS. 2 and 3 show the specific geometry of the feeder tube as claimed herein. A capillary end portion 21 of feeder tube 18 is shown being cylindrical in configuration and being attached to flattened portion 22. Flattened portion 22 is U-shaped and has capillary end portion 21 attached to one end and discharge end portion 23 attached to the other. Discharge end 23 is somewhat S-shaped in configuration and has bead 24 located at one end thereto to aid in the assembly of a bell and spigot joint. A header for directing the refrigerant from the feeder tube to multiple circuits of the evaporator may be joined to the discharge end of the feeder tube.

Flattened portion 22 is typically formed by placing the cylindrical member in a press and having the press partially close to flatten a portion of the cylindrical tube. This flattened length has a reduced cross-sectional area such that as the refrigerant flows from the capillary it flows first into the larger end portion 21 and then into the reduced cross-sectional area portion 22 and finally into the larger cross-sectional area portion of discharge end 23 all acting to effect noise suppression as concerns the refrigerant flowing therethrough.

Figure 4:
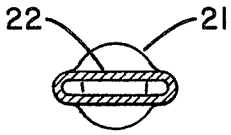
FIG. 4 is a sectional view of FIG. 2 taken at line IV—IV.

FIGS. 3 and 4 specifically show the reduction of the cross-sectional thickness of the feeder tube as the refrigerant flows from the capillary end portion 21 to the flattened portion 22. This is a significant change in thickness which acts to effect the noise suppression herein. Of course, there is some additional suppression as the refrigerant flows from the small diameter capillary into the larger capillary end portion 21.

The invention herein has been described with reference to a particular embodiment. It is to be understood by those skilled in the art that modifications and variations can be effected thereto within the spirit and scope of the invention.

What is claimed is:

1. A vapor compression refrigerant circuit including a compressor, condenser, evaporator and expansion device all connected to form a refrigeration circuit which comprises a feeder tube joining the expansion device to the evaporator, said feeder tube having a first cylindrical end for joining to the expansion device, a flattened portion of reduced cross-sectional area and a discharge end cylindrical in configuration for joining to the evaporator, said flattened portion acting to suppress noise caused by the flow of refrigerant from the expansion device to the evaporator.

2. The apparatus as set forth in claim 1 wherein the feeder tube is a single integral part having a flattened portion between the cylindrical ends.

3. The apparatus as set forth in claim 2 wherein the flattened portion is U-shaped.

4. The apparatus as set forth in claim 3 wherein the expansion device is a copper or aluminum capillary tube, wherein the feeder tube is copper or aluminum and wherein the feeder tube is joined to the capillary tube and the evaporator by soldering or brazing.

* * * * *